US006025306A

United States Patent [19]

Erdemir

[11] Patent Number: 6,025,306

[45] Date of Patent: Feb. 15, 2000

[54] LUBRICATION WITH BORIC ACID ADDITIVES

[75] Inventor: Ali Erdemir, Naperville, Ill.

[73] Assignee: ARCH Development Corporation, Chicago, Ill.

[21] Appl. No.: 08/720,221

[22] Filed: Sep. 26, 1996

Related U.S. Application Data

[63] Continuation of application No. 08/481,657, Jun. 7, 1995, abandoned, which is a continuation of application No. 08/255,231, Jun. 7, 1994, Pat. No. 5,431,830, which is a continuation of application No. 07/899,665, Jun. 16, 1992, abandoned.

[51] Int. Cl.[7] ..... C10L 141/04; C08L 3/00; C08F 3/38

[52] U.S. Cl. ..... 508/125; 508/105; 508/106; 524/47; 524/48; 524/52; 524/405; 524/183

[58] Field of Search ..... 508/105, 106, 508/108, 109, 125, 156; 524/405, 183, 47, 48, 52

[56] References Cited

U.S. PATENT DOCUMENTS

| | | | |
|---|---|---|---|
| 905,649 | 1/1908 | Chapman | 252/30 |
| 3,629,112 | 12/1971 | Gower et al. . | |
| 3,779,918 | 12/1973 | Ikeda et al. | 508/101 |
| 4,144,166 | 3/1979 | DeJovine . | |
| 4,204,968 | 5/1980 | Mack et al. . | |
| 4,297,227 | 10/1981 | Whitte et al. | 252/25 |
| 4,305,831 | 12/1981 | Johnson, III et al. . | |
| 4,339,339 | 7/1982 | Maciejewski | 252/75 |
| 4,411,804 | 10/1983 | DeVries | 252/30 |
| 4,439,571 | 3/1984 | Dufour et al. | 524/183 |
| 4,482,649 | 11/1984 | Miutel et al. | 525/529 |
| 4,534,872 | 8/1985 | Horodysky et al. . | |
| 4,534,873 | 8/1985 | Clark . | |
| 4,713,186 | 12/1987 | Kristen et al. . | |
| 4,715,972 | 12/1987 | Pacholke | 252/30 |
| 4,735,146 | 4/1988 | Wallace | 252/30 |
| 4,788,987 | 12/1988 | Bartlett . | |
| 4,858,534 | 8/1989 | Wallace | 252/30 |
| 4,935,164 | 6/1990 | Wessling et al. | 252/500 |
| 4,995,994 | 2/1991 | Singer . | |
| 5,006,270 | 4/1991 | Farng et al. . | |
| 5,093,015 | 3/1992 | Oldiges . | |
| 5,130,352 | 7/1992 | Chow | 524/405 |
| 5,173,204 | 12/1992 | Chiddick et al. | 252/30 |
| 5,234,977 | 8/1993 | Bastioli et al. | 524/405 |
| 5,352,721 | 10/1994 | Takayangi et al. | 524/405 |
| 5,384,352 | 1/1995 | Andres et al. | 524/405 |
| 5,431,830 | 7/1995 | Erdemir | 141/4 |

*Primary Examiner*—Margaret Medley
*Attorney, Agent, or Firm*—Michael D. Rechtin; Foley & Lardner

[57] ABSTRACT

Self-lubricating resin compositions including a boric acid additive and a synthetic polymer including those thermoset materials.

25 Claims, 1 Drawing Sheet

LUBRICATION WITH BORIC ACID ADDITIVES

The present application is a continuation of U.S. Ser. No. 08/481,657 filed Jun. 7, 1995 (now abandoned) which is a continuation in part of U.S. Ser. No. 08/255,231 (now U.S. Pat. No. 5,431,830) which is a continuation of U.S. Ser. No. 07/899,665 filed Jun. 16, 1992 (now abandoned).

The U.S. Government has rights in this invention pursuant to Contract No. W-31-109-ENG-38 between the U.S. Department of Energy and Argonne National Labortatory.

BACKGROUND OF THE INVENTION

This invention is directed to an improved lubricant prepared from a mixture of boric acid and oil or grease or other such base medium lubricant This invention also relates to an improved selflubricating composite lubricant prepared from a mixture of boric acid and/or boric acid-forming boron oxide and various engineering polymers. More particularly, the invention relates to a mixture containing boric acid particles in a mixture and/or suspension with a particular range of particle sizes and amounts. Lubricants serve an important function in preserving machine components and extending machine operating lifetimes. Optimization of lubricant properties has remained a primary objective as machines are operated under more demanding and difficult conditions associated with increased efficiency and performance. Numerous additives have been developed, but much remains to be done to accommodate the increased demands now being made of lubricants.

OBJECTS OF THE INVENTION

It is therefore an object of the invention to provide an improved lubricant

It is another object of the invention to provide a novel lubricant additive.

It is a further object of the invention to provide an improved solid phase lubricant additive.

It is an additional object of the invention to provide a novel lubricant of boric acid solids dispersed in a base lubricant, for use as is or as a concentrate for subsequent addition to another lubricant to impart improved lubricity.

It is yet another object of the invention to provide an improved method of lubricating ceramic, resin and/or metal components using a boric acid additive.

It is still a further object of the invention to provide a novel multifunctional lubricant having boric acid and polymer solids additives to a base lubricant It is also an additional object of the invention to provide an improved solid lubricant and method of use as part of a resinous/polymeric composite and/or system.

Other objects, features and advantages of the present invention will be apparent to those skilled in the art, from the following summary and claims, taken in conjunction with the accompanying figures and examples.

SUMMARY OF THE INVENTION

Figure 1:
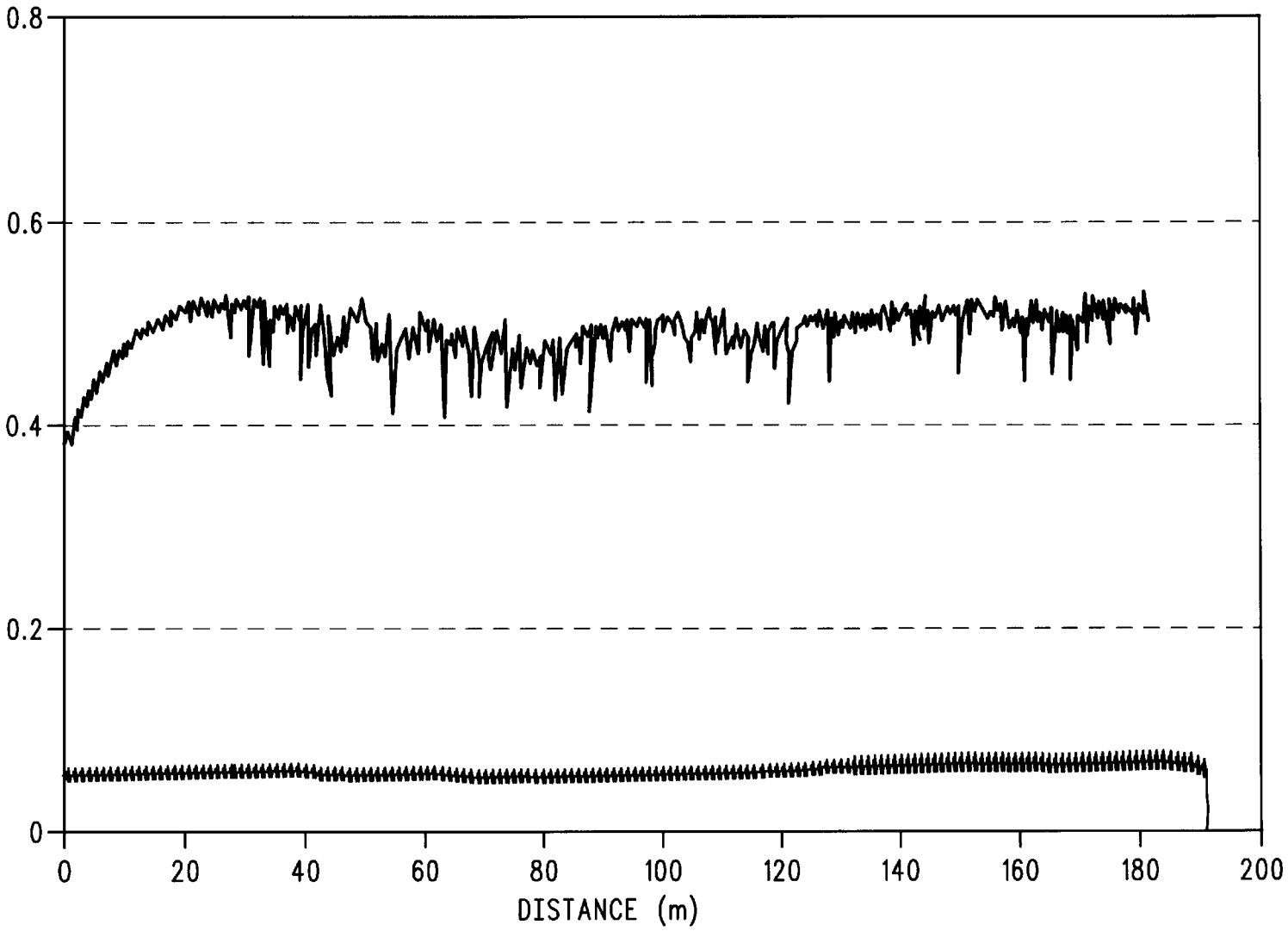
FIG. 1 is a graphic illustration comparing the coefficients of friction of a polyimide resin composite and a polyimide resin having incorporated therein a boric acid additive, in accordance with the present invention, as explained in Table III below and the accompanying text. The upper plot shows the coefficient determined for the base polyimide system and the lower plot corresponds to a polyimide/boric acid/oxide composite of the present invention. Consistent with the referenced ASTM procedure, the comparison was conducted at 10 N, 6 rpm, 24–80% R.H. and RTemp.

This invention, in its various aspects, provides lubricating compositions, as well as resin compositions. The invention overcomes certain well-known problems and deficiencies in the prior art, including those outlined above. In part, the present invention is a lubricating composition including a solid crystalline boric acid and a non-aqueous base lubricant. In preferred embodiments, the non-aqueous base lubricant includes but is not limited to petroleum oils, mineral oils, synthetic oils, silicon oils, mixtures of these oils, non-aqueous solvents, mineral greases, synthetic-based greases and mixtures thereof. Likewise, in preferred embodiments, the friction and wear-reducing boric acid is about 0.05–50 weight percent of the composition. In highly-preferred embodiments, the boric acid is about 0.1–1.0 weight percent of the composition. Likewise, the boric acid has a crystal dimension of about 0.1–40 microns. As will be understood by those skilled in the art, increasing advantage is gains through use of boric acid having a smaller particulate/crystalline size. Any particulate/crystalline dimension is limited only by the technology available to provide the boric acid of this invention. Likewise, the weight percent of the boric acid component is limited only by available formulation techniques and those quantities of boric acid which are required to improve lubricity. The same and similar features of this invention apply with equal effect to resin compositions, including those described below.

Embodiments of such lubricating compositions can flirter include additives such as antioxidants, metal passivators, rust inhibitors, viscosity index improvers, poor-point depressants, dispersants, detergents, extreme pressure additives, anti-wear additives, and mixtures thereof. In particular, where an additional additive is a dispersant, the dispersant is present in an amount sufficient to maintain the boric acid dispersed homogeneously throughout the base lubricant.

A highly-preferred embodiment is one where the base lubricant is a grease. Alternatively, and without limitation, a highly-preferred embodiment is an oil composition having added thereto a lubricating composition such as that described above. With respect to the latter embodiment, the base lubricant can be or include a non-aqueous solvent having a higher concentration or weight percent of boric acid, such that upon addition to an oil composition the boric acid is present therein in an amount sufficient to provide the desired lubricating properties. In such a manner, the lubricating compositions of the present invention can be used as a concentrate for subsequent addition to oils, greases and the like.

In part, the present invention is a solid resin composition including a particulate boric acid additive and a synthetic polymer, whereby the boric acid additive is disbursed within the polymer in an amount sufficient to lubricate the composition during formation from its components and subsequent processing. In addition thereto, such resins are imparted with unexpected and exceptionally low friction and wear properties useful in the context of various sliding, rolling and rotating contacts. In one form of the present invention, the additive is the hydration product of boric oxide and water under resin formation and/or processing conditions. Regardless of additive identity, the boric acid additive is about 0.05–50 weight percent of the composition. In highly-preferred embodiments, the boric acid additive is about 0.1–1.0 weight percent.

In preferred embodiments, the boric acid additive has a particulate dimension of about 0.1–500 microns. Likewise, as understood by those skilled in the art, even distribution of the additive is preferred although not necessary. With respect to particulate dimension, it will be understood by those skilled in the art made aware of this invention, that dimension can be a function of resin application, as well as processing and formulation parameters. In addition to the considerations previously mentioned, any particulate dimension technologically achievable can be used with the present invention, realizing that crystal fracture may decrease the observed lubricity from the level desired.

In preferred embodiments, polymers useful in conjunction with the present resin composition include but are not limited to polyimides, polyamides, epoxies, polyolefins, including ®Teflon materials and structurally-related fluorinated polymers, and polyurethanes. Alternatively, with similar effect, such a polymer can be a thermoset plastic material.

Various embodiments of this invention can be used in conjunction with other lubricants and/or fillers, including but not limited to graphite, molybdenum disulfide, and fluorinated polyethylenes. Likewise, such resin compositions can include carbon fibers.

In part, the present invention is a self-lubricating resin composition including a boric acid additive and a thermoset polymer, whereby the boric acid additive is dispersed within the composition in an amount sufficient to reduce the coefficient of friction of the composition. In preferred embodiments, the additive is boric oxide, such that boric acid is formed upon reaction with water under resin formulation and/or processing conditions.

Regardless of whether the additive is a friction or wear-reducing boric oxide, such an additive is preferably about 0.05–50 weight percent of the composition. In highly preferred embodiments, the additive is boric oxide present at about 1.0–20 weight percent of the composition. In addition to the considerations mentioned above, irrespective of whether the additive is boric oxide, the additive is preferably a particulate dimension that about 0.1–500 microns. Such self-lubricating resins can include carbon fibers as an additional component.

In one of the preferred forms of the invention, an additive to a base lubricant takes the form of a dispersion of boric acid or boric acid-forming boron oxide. The boric acid additive of this embodiment is available in the form of solid particles with particle sizes in the range of about 0.5 to 100 microns in diameter. The preferred form of this additive is essentially boric acid powders and is available from U.S. Borax Co. of Los Angles, Calif. The resulting lubricant with boric acid dispersion therein takes advantage of the low friction properties of boric acid when suspended in lubricants. Examples of base lubricants are oils such as petroleum based oils, synthetic oils, mineral oils, hydrocarbon based oils and silicon oils or other suitable lubricants which preferably do not react with boric acid. For example, undesirable reactions can include destruction or substantial disturbance of the layered crystal structure of boric acid. Without limiting the scope of the invention it is believed the particles of boric acid, under high pressure and frictional traction, interact with load-bearing surfaces to provide excellent resilience and load carrying capacity. The layer structure of crystalline boric acid particles can slide over each other with relative ease and can reduce friction and wear.

In this invention boric acid is particularly useful for systems running at temperatures up to about 170° C. The boric acid is then dispersed as a component in base lubricants with the result being a substantially improved performance for the mixture.

In another embodiment boric acid and boric acid-forming boric oxide can be mixed with polymers and used as a lubricant for temperatures up to about 170° C. The resulting lubricant provides an improved performance for the mixture. Tests show an improvement of the order of 10–1,000% over that for a corresponding conventional lubricant, particularly for lubricating systems where the lubricant is being circulated.

In the most preferred embodiment the particle size for boric acid is from about 0.2 to 40 microns to facilitate the formation of a stable suspension with the boric acid being present in a amount of at least 0.1 to 0.2% by weight The amount of solid particles that can be mixed and/or dispersed in the oil will be dependent on the size of the particle. The smaller the size of particle, the greater the amount of particles that can be suspended in oil. In general, the preferred range for oils is about 0.5 to 50% by weight and for greases is about 1–50% by weight with the most preferred range being 1–15% for oils and 1–20% for greases.

The size and amount of boric acid particles to be added to oils and greases will be generally determined by the intended use of the resulting lubricant mixture having the solid particles in suspension. Conventional equipment and techniques can be employed to achieve substantially uniform or stable dispersion or distribution of the additive in the final mixture. Stable dispersion means a mixture in which solid lubricating particles remain as separate, discrete particles in the presence of a stabilizer and a carrier fluid medium Methods of achieving a uniform dispersion of the particles in the base lubricant are well-known to those in the art. Concentrates comprising higher amounts of boric acid can also be prepared first and then added to conventional oils or greases. The lubricants can, in addition, contain other additives which are added to improve the fundamental properties of lubricants even further. Such additives may include: antioxidants, metal passivators, rust inhibitors, viscosity index improvers, pour point depressants, dispersants, detergents, extreme pressure additives of liquid and solid types and anti-wear additives. The base lubricant greases useful in the preparation of the lubricant composition of the invention can be any of the known greases employed as bases for extreme pressure applications.

Preliminary tests indicate that compared with the untreated base polymers, the self-lubricating polymer composites prepared according to this invention afford 50% to 90% reduction in friction while reducing wear to unmeasurable levels. It has been found that boron oxide particles incorporated in conventional polymers enhance their anti-wear and antifriction properties and increase their mechanical strength and load carrying capacity. The lubricant additive of present invention provides moving resin/polymer surfaces with very low friction and wear. Therefore, sliding performance and wear life of these polymers increase substantially. While the temperature, noise level and vibration of sliding bodies decrease, efficiency increases markedly.

These and other benefits which will be evident to those of ordinary skill in the art can be accomplished by using the fillers of this invention in the form of a mixture of boron oxide and polymers to enhance their friction and wear properties.

The additive of this invention is boron oxide and available in the form of solid particles with particle sizes of below about 0.5 to 1,000 microns in diameter. The mixtures of this invention are unique and take advantage of the slippery boric acid films that form spontaneously on the surface of boron oxide mixed with a suitable polymer. The particles of boron oxide, under high pressure and frictional traction, interact with load-bearing surfaces and form a boric acid film of excellent resilience and load carrying capacity. Boric oxide particles mixed with polymers form boric acid on the exposed surface by reacting with moisture in the surrounding atmosphere. The surface film consisting of the layers of crystalline boric acid and these layers can slide over each other with relative ease and reduce friction and wear.

For such composite structures of boron oxide in polymers, an improvement in performance in the order of two to nine times is feasible. These types of polymer composites can be used in friction and wear applications and are well-known to those in the art of making self-lubricating polymer composites. It is preferred that the particle size of boric acid-forming boron oxide be in the range of 0.1 to 500 microns, and in an amount greater than 0.05% by weight, depending on the intended use of polymers. The amount of solid boron oxide particles that can be mixed and/or dispersed in the polymer will be dependent on the size of the particle. The smaller the size of particle, the greater the amount of boron oxide that can be incorporated in polymers. In general a preferred range is 0.05% to 50% by weight with a most preferred range being 1 to 20%. The size and amount of boric acid particles to be added to polymers will be determined by the intended use of the resultant composite structure. Conventional equipment and techniques can be employed to achieve an even distribution of the boric oxide additive in the final composition. Such dispersion methods are well-known to those in the art of making dispersions of solids in solid media. These polymers can include plastics, rubbers, elastomers, polyimides, nylons, epoxy resins, and Teflon. The selection of specific polymer for mixing varies with the intended use and can be readily determined by one of ordinary skill in the art.

EXAMPLES

The following examples are intended to be merely illustrative of the invention and not in limitation thereof Unless otherwise indicated, all quantities are by weight.

Example 1

Mixture of boric acid and lubricant oil or grease.

This example illustrates the extent of performance improvement with the use of a mixture of boric acid and oil or grease. In this example, a commercially available mineral and motor oil or grease are mixed with boric acid powder having particle sizes from about 0.240 microns in amounts ranging from 1 to 50% by weight. The mixture was put in a glass container and stirred vigorously by means of a magnetic stirring device for a period of at least 2 hours. The mixture was then used as a lubricant on a wear test machine whose function and main features may be found in the 1990 Annual Book of ASTM Standards, Volume 3.02, Section 3, pages 391–395. In the tests, steel (440C, and 52100) and alumina ($Al_2O_3$) pins with a hemispherical tip radius of 5 in (127 mm) was secured on the pin-holder of the wear test machine and pressed against a rotating steel or alumina disk. A specific load is applied through a lever system which presses the stationary pin-holder downward against the rotating disk. The lubricant under test covers the stationary pin. After the test which is run for a specified distance at specified temperature, pressure and speed, the steady-state friction coefficient is obtained from a chart recorder and is shown in Table I. The wear rate was calculated from a formula given in the 1990 Annual Book of ASTM Standards, Volume 3.02, Section 3, page 394, expressed in cubic millimeter per meter ($mm^3/m$). The wear results and friction coefficient obtained are summarized in Table II.

TABLE I

Friction test results from various pin and disk pairs under different loads. Test conditions: Speed, 1–3 mm/s; Temperature, 22–25° C.; 440C and 52100 steel pins and disks.

| Lubricant | Pin/Disk Material | Load (kg) | Sliding Distance (m) | Friction Coefficient |
|---|---|---|---|---|
| Base Mineral Oil | 440C/52100 | 5 | 27 | 0.15 |
| 50% by Weight Boric Acid and Base Mineral Oil | 440C/52100 | 5 | 27 | 0.02 |
| 10% by Weight Boric Acid and Base Mineral Oil | 440C152100 | 4 | 26 | 0.01 |
| 10% by weight Boric Acid and Base Mineral Oil | 440C/52100 | 2 | 2000 | 0.03 |
| 10% by Weight Boric Acid and Base Mineral Oil | 440C/52100 | 2 | 450 | 0.03 |
| 15W40 Motor Oil | 440C/440C | 2 | 180 | 0.11 |
| 1% by Weight Boric Acid and 15W40 Oil | 440C/440C | 2 | 180 | 0.09 |
| Petroleum Base Grease | 440C/440C | 5 | | 0.11 |
| 20% by Weight Boric Acid and Petroleum Base Grease | 440C/440C | 5 | | 0.05–0.07 |

TABLE II

Wear Test on Pin-on-disk Machine. Test conditions: Load, 2 kg; Speed, 1–3 mm/s; Temperature, 22–25° C.; 440C, 52100 steel and alumina pins and/or disks.

| Lubricant | Pin/Disk Material | Sliding Distance (m) | Friction Coefficient | Wear Rate ($mm^3/m$) |
|---|---|---|---|---|
| Base Mineral Oil | $52100/Al_2O_3$ | 57 | 0.16 | $1.1 \times 10^{-4}$ |
| 10% by Weight Boric Acid and Base Mineral Oil | $52100/Al_2O_3$ | 70 | 0.03 | $2.0 \times 10^{-6}$ |
| Base Mineral Oil | $Al_2O_3/Al_2O_3$ | 70 | 0.25 | $2.8 \times 10^{-4}$ |
| 10% by Weight Boric Acid and Base Mineral Oil | $Al_2O_3/Al_2O_3$ | 92 | 0.025 | $2.6 \times 10^{-6}$ |

Example 2

A concentrated (about ten weight percent) aqueous solution of boric acid was prepared at 70° C., using a magnetic stirrer. Caution was taken to prevent any visible precipitation occurring during mixing/dissolution process. The concentrated boric acid solution was homogeneously combined with a petroleum-based grease product at 70° C., also with magnetic stirring. The combined grease/boric acid mixture was placed in a dehydration oven maintained at subatmospheric pressures (between 5 to 27 inches of Hg) and a temperature of about 250° F. to induce flash vaporization and provide the resulting grease product.

The grease product, prepared as described above, was subjected to raman spectroscopy, a useful technique by which to analyze the crystalline morphology, or lack thereof, of a chemical compound. In contrast to infra red spectroscopy which is based on the absorption of radiation, raman spectroscopy involves the reflection of radiation as a result of a well-defined molecular structure. Whereas a crystalline material has a well-defined three dimensional structure which provides a unique raman spectrum, an amorphous material provides a raman spectrum without any defining characteristics consistent with a material lacking a crystalline structure. The grease product, prepared as described above, was analyzed with raman spectroscopy about 20 hours after preparation, comparing it first to the spectrum of neat grease and then to the spectrum of crystalline boric acid The boric acid raman spectrum is characterized by a pronounced peak at or about 875 $cm^{-1}$. In contrast, the raman spectrum of the aforementioned grease product does not give any response at 875 $cm^{-1}$, but shows a sharp peak at 823 $cm^{-1}$. The spectrum is notable by the absence of the characteristic peak (875 $cm^{-1}$) of boric acid, demonstrating that the grease mixture product does not include crystalline boric acid.

In contrast, a boric acid/grease mixture, prepared according to the present invention, provided a raman spectrum showing a peak at 876 $cm^{-1}$, characteristic of crystalline boric acid which is absent in the spectrum of the aforementioned grease product. (The lesser peak intensity and slight positional shift is attributable to a low-concentration mixture versus solid boric acid.)

To further characterize the present invention, a boric oxide composition was prepared to evaluate the ability of such a composition to form boric acid by absorbing atmospheric moisture. Accordingly, a commercially-available boric oxide powder was placed in a dehydration oven and heated at 350° F. under subatmospheric pressures of about 27 inches of Hg for about 20 to 25 minutes to remove any moisture previously absorbed. The anhydrous boric oxide so obtained was combined with a petroleum-based grease by manual and magnetic stirring. The boric oxide/grease mixture so obtained was exposed to atmospheric moisture, at room temperature, for about 20 hours.

The raman spectrum of the boric oxide/grease mixture does not show the characteristic peak (875 $cm^{-1}$) associated with boric acid and attributable to the crystalline structure thereof demonstrating that boric oxide does not hydrate and form boric acid without exposure to atmospheric moisture and absent specific processing temperatures.

Example 3

Mixture of boric acid and boric oxide, which forms boric acid, and polymer. This example illustrates the extent of performance improvement with the use of a mixture of a boric acid additive, when used in conjunction with a number of representative, commercially available polymers. In this example, the polymers are mixed with boron oxide powders having particle sizes from about 0.2 to 40 microns in amounts ranging from 1% to 20% by weight. The mixture of polymer and boron oxide powder was put in a glass container and stirred vigorously by means of a mechanical mixer for a period of at least two hours. The mixture was first compacted, then hot-pressed and finally cured at an optimum temperature to assume a dense, solid disk shape. The resulting resin composite/composition was then tested on a wear test machine, the function, features and procedures for which may be found in the 1990 Annual Book of ASTM Standards, Volume 3.02, Section 3, pages 391–395. In the tests, steel (440C, M50 and 52100) pins with a hemispherical tip radius of 5 inches (127 mm) were secured on the pin-holder of the wear test machine and pressed against the rotating resin disk (with comparisons made to composites prepared without a boric acid additive). Specific load is applied through a lever system which presses the stationary pin holder downward against the rotating disk. After the test, which is run for a specified time/distance/rotation at specified temperature, pressure and speed, the steady-state friction coefficient is obtained from a chart recorder. The recorded coefficients are as provided below in Table III.

TABLE III

| Pin/Disk Material | Friction Coefficient | Wear |
|---|---|---|
| 440C/Epoxy Without Boric Oxide | 0.65 | Significant wear on pin. Significant wear on disk. Significant amount of wear on pin. |
| 440C/Epoxy With 10% By Weight Boric Oxide | 0.13 | Boric acid transfer to pin surface, only minor scratches were visible at 50× magnification on an optical microscope. Insignificant wear on disk. |
| 52100 pin/Polyimide disk | 0.55 | Major wear damage on pin surface. Significant wear on rubbing disk surface. |
| 52100 pin/Polyimide disk with 20% by weight Boron Oxide | 0.06 | No wear on pin surface. Insignificant wear on disk. |
| M50 Steel Pin/Nylon 6/6 | 0.3–0.5 | Major wear on pin surface. Deep wear groove on nylon disk. |
| M50 Steel Pin/5% by weight boron oxide containing nylon 6/6 | 0.1 | Minor wear on pin and disk surface. |

Table 1. Friction test results from various steel pins and selected polymer disks. Test conditions: Load, 0.5 to 1 kg; Speed, 1–4 mm/s; Temperature, 22–25° C.; Sliding distance, 180 m; Test pairs, various steel pins and polymer disks with and without boron oxide particles.

The above results demonstrate that the mixtures of boron oxide and a polymer material reduced friction coefficients by factors of three to nine below those of the unmixed, pure polymers. The wear of steel pins sliding against the pure polymers was significant, but the wear of the same pins sliding against the boron oxide containing polymers were virtually unmeasurable, as illustrated in FIG. 1 for the polyimide system summarized in Table III. It is understood by those skilled in the art that the methodology invoked for the studies summarized in Table III is indicative of the wear (or lack thereof) incurred by such resin compositions both during processing and through later use.

While this invention has been described by way of various specific examples and embodiments, it is important to understand that the invention is not limited thereto, and that the invention can be practiced in a number of ways within the scope of the following claims. Other advantages and features of the invention will become apparent from the claims, with the scope of the claims determined by the reasonable equivalents thereof as understood by those skilled in the art.

What is claimed is:

1. A resin composition comprising a thermoplastic resin and a particulate boric acid additive having a particulate dimension of about 0.1 to 500 microns, said boric acid additive dispersed within said resin in an amount sufficient to reduce the coefficient of friction of the composition.

2. The resin composition of claim 1 wherein said additive is the hydration product of boric oxide and water under resin formation conditions.

3. The resin composition of claim 1 wherein said boric acid additive is about 0.05–50 weight percent of said composition.

4. The resin composition of claim 3 wherein said boric acid additive is about 0.1–1.0 weight percent of said composition.

5. The resin composition of claim 1 wherein said boric acid additive has a particulate dimension of about 0.1–500 microns.

6. The thermoplastic resin composition of claim 1 wherein said resin is a condensation polymer.

7. The resin composition of claim 6 wherein said polymer is selected from the group consisting of a polyimide, a polyamide, and a polyurethane.

8. The resin composition of claim 1 further including other lubricants selected from the group consisting of graphite, molybdenum disulfide, and fluorinated polyethylenes.

9. The resin composition of claim 1 further including carbon fibers.

10. In a resin composition of the type including a thermoset polymer, the improvement comprising a boric acid additive dispersed within said composition in an amount sufficient to reduce the coefficient of friction of said composition, the boric acid additive being a particulate having a dimension of about 0.1 to 500 microns.

11. The resin composition of claim 10 wherein said additive is boric acid, such that boric acid is formed upon reaction of boric oxide with water under resin formation conditions.

12. The resin composition of claim 11 wherein said boric oxide is about 0.05–50 weight percent of said composition.

13. The resin composition of claim 12 wherein said boric oxide is about 1.0–20 weight percent of said composition.

14. The resin composition of claim 11 wherein said boric oxide is particulate and dimensioned at about 0.1–500 microns.

15. The resin composition of claim 14 further including carbon fibers.

16. In a polyolefin composition, the improvement comprising a film of boric acid on the surface of said composition.

17. The composition of claim 16 wherein said boric acid is about 0.05–50 weight percent of said composition.

18. The resin composition of claim 17 wherein said boric acid is about 0.1–1.0 weight percent of said composition.

19. The resin composition of claim 16 further including other lubricants selected from the group consisting of graphite, molybdenum disulfide and fluorinated polyethylenes.

20. The resin composition of claim 16 further including carbon fibers.

21. A method of using boric acid to reduce the coefficient of friction of a polymeric composition, said method comprising the steps of:

providing a polymer material; and incorporating with said polymer material a boric acid additive the boric acid additive being a particulate having a dimension of about 0.1 to 500 microns.

22. The method of claim 21 wherein said additive is boric oxide, such that boric acid is formed upon reaction of boric oxide with water under conditions to prepare said polymeric composition.

23. The method of claim 22 wherein said boric oxide is about 0.05–50 weight percent of said composition.

24. The method of claim 21 wherein said polymeric composition is a condensation polymer.

25. The method of claim 24 wherein said polymer is selected from the group consisting of a polyimide, a polyamide and a polyurethane.

* * * * *

UNITED STATES PATENT AND TRADEMARK OFFICE

CERTIFICATE OF CORRECTION

PATENT NO. : 6,025,306

DATED : February 15, 2000

INVENTOR(S) : Erdemir

It is certified that error appears in the above-identified patent and that said Letters Patent is hereby corrected as shown below:

Col. 2, line 23, change "gains" to - - gained - -.

Col. 2, line 33, change "flirter" to - - further - -.

Col. 3, line 18, change "®Teflon" to - - Teflon® - -.

Col. 3, line 42, after "that", add - - is - -.

Col. 3, line 52, change "Angles" to - - Angeles - -.

Col. 5, line 35, change "Teflon" to - - Teflon® - -.

Col. 5, line 52, change "0.240" to - - 0.2-40 - -.

Col. 6, in Table II, change the third entry in the column titled "Sliding Distance (m)" from "70" to - - 80 - -.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*